United States Patent [19]

Mishima et al.

[11] 4,406,694

[45] Sep. 27, 1983

[54] PROCESS FOR PRODUCING ACICULAR FERROMAGNETIC ALLOY PARTICLES AND ACICULAR FERROMAGNETIC ALLOY PARTICLES OBTAINED BY THE SAID PROCESS

[75] Inventors: Akio Mishima; Yosiro Okuda; Tosiharu Harada; Akira Mukaizaka, all of Hiroshima, Japan

[73] Assignee: Toda Kogyo Corp., Hiroshima, Japan

[21] Appl. No.: 285,983

[22] Filed: Jul. 23, 1981

[30] Foreign Application Priority Data

Aug. 5, 1980 [JP] Japan ..... 55-108577

[51] Int. Cl.[3] ..... B22F 1/02; B22F 9/18

[52] U.S. Cl. ..... 75/0.5 AA; 75/0.5 BA; 148/105

[58] Field of Search ..... 75/0.5 AA, 0.5 BA; 148/105; 423/151, 152

[56] References Cited

U.S. PATENT DOCUMENTS

| | | | |
|---|---|---|---|
| 4,290,799 | 9/1981 | Schroeder et al. | 75/0.5 AA |
| 4,323,596 | 4/1982 | Buxbaum | 75/0.5 AA |
| 4,347,291 | 8/1982 | Tokuoka | 75/0.5 AA |

OTHER PUBLICATIONS

Japan Society of Powder and Powder Metallurgy, 1974, Journal of the Japan Society of Powder and Powder Metallurgy, pp. 108–109. Translation provided.

*Primary Examiner*—W. Stallard

*Attorney, Agent, or Firm*—Wegner & Bretschneider

[57] ABSTRACT

A process for producing an acicular ferromagnetic alloy particles mainly containing iron and magnesium, which comprises preparing a suspension of iron(II) hydroxide and water-soluble magnesium salt, the suspension having a pH value of at least 11 and containing the magnesium salt in an amount of 0.5 to 20.0 atomic % based on the amount of the iron(II) hydroxide in the suspension and calculated as the ratio of Mg to Fe(II), oxidizing the suspension with an oxygen-containing gas to form an acicular particles of iron(III) oxide hydroxide substituted with magnesium, forming coats of phosphorus compound and subsequent silicon compound on the acicular particles, heating the resultant particle at 500° to 900° C. under a non-reducing atmosphere and then reheating the particle thus treated at 350° to 600° C. under reducing atmosphere.

8 Claims, 6 Drawing Figures

PROCESS FOR PRODUCING ACICULAR FERROMAGNETIC ALLOY PARTICLES AND ACICULAR FERROMAGNETIC ALLOY PARTICLES OBTAINED BY THE SAID PROCESS

BACKGROUND AND SUMMARY OF THE INVENTION

The present invention relates to a process for producing acicular ferromagnetic alloy particles of improved particle properties, especially higher long axis-to-short axis ratio and magnetic properties suitable as a magnetic material for use in magnetic recording medium.

Recently, with the progress of miniaturizing and lightening of the reproducing apparatus for magnetic recording, the necessity for improving the qualities of the magnetic recording media such as magnetic tape, magnetic disc and the likes has been more and more increasing. Namely, the magnetic recording media of high bit density, higher output and especially, improved frequency characteristic has been requested. The magnetic material suitable for fulfilling such a requests should have a high coercive force(Hc) and large saturation magnetization($\sigma$s).

Furthermore, the above-mentioned specific properties of magnetic recording media depend upon its residual magnetic flux density(Br), and the latter depends upon the specific properties of the magnetic powder such as their dispersibility in the vehicle, their orientation and packing property in a coating medium.

The magnetic materials conventionally employed in magnetic recording media are acicular ferromagnetic iron oxide particles such as magnetite, maghemite, Co-magnetite and Co-maghemite. Although such a ferromagnetic iron oxide particles are of relatively large coercive force(Hc) and relatively large saturation magnetization($\sigma$s), there are limits in their magnetic properties and the limits are not satisfactory. Accordingly, the research and development for improving the magnetic properties of acicular ferromagnetic particles have been extensively carried out. The magnetic materials of improved magnetic properties are acicular ferromagnetic iron particles and acicular ferromagnetic alloy particles obtained generally by reducing acicular particles of $\alpha$-iron(III) oxide hydroxide, acicular $\alpha$-ferric oxide particles or each of these containing metal(s) different from iron in a flow of reducing gas at about 350° C.

Since the coercive force(Hc) of the magnetic material depends on the shape-anisotropy of the magnetic particles, it is necessary for the improvement of magnetic properties that $\alpha$-iron (III) oxide hydroxide particles as starting material are in the excellent acicularity, that is, the long axis-to-short axis ratio of the particle (hereinafter referred to as the axial ratio of the particle) is high. Moreover, the process by which the acicularity of the starting material is kept during its heat-treatment is also important.

Hitherto, the most representative process for producing the acicular particle of $\alpha$-iron(III) oxide hydroxide has been the process by which an aqueous suspension containing precipitated ferrous hydroxide obtained by adding an aqueous alkali solution in an amount more than the equivalent into an aqueous solution of a ferrous salt is oxidized at a temperature of lower than 80° C. and at a ph of over 11. The thus obtained acicular particles of $\alpha$-iron(III) oxide hydroxide are around 0.5 to 15 $\mu$m in length of long axis and their axial ratio is at most 10:1, they being not to be said the excellent needle-like form.

In the case where the acicular particles of $\alpha$-iron(III) oxide hydroxide of the axial ratio of about 10:1 are converted via a step of reduction to the acicular magnetic particles, since the particles shrink in their volume, the axial ratio of the obtained acicular magnetic particles becomes to at most 2:1.

A method for preparing the acicular particles of $\alpha$-iron(III) oxide hydroxide of a high axial ratio is to add a certain kind of metal ion other than iron into the aqueous solution of the ferrous salt, the certain kind of metal ion other than iron being, for instance, Co, Ni, Cr, Mn, Cd, and the likes.

However, it has been known that the addition of the metal ion other than iron generally causes the ultramicronization of the particles, the tendency becoming more and more conspicuous with the increase of the amount of the addition of such ions. The thus ultramicronized particles of $\alpha$-iron(III) oxide hydroxide are not suitable as the starting material for preparing magnetic particles for use in magnetic recording.

Another method is to add magnesium sulfate into the ferrous salt solution in an amount of 0.2 to 2 wt% based on the amount of the ferrous salt and calculated as the ratio of Mg to Fe(II) in the presence of alkali carbonate at a pH of 7 to 11 (refer to the Abstracted Proceedings of Spring General Meeting of the Japan Society of Powder and Powder Metallurgy, 1974, page 108). However, the method aimes to obtain the particle of $\alpha$-iron(III) oxide hydroxide in a spindle-like shape, and actually, the thus obtained particles are spindle-like in their shape with a very minute diameter. In addition, this method also includes the ultramicronization of the particles. Accordingly, also the magnetic properties of the magnetic particles prepared from the thus-obtained particles are not satisfactory.

On the other hand, the acicular ferromagnetic alloy particles are obtained, as has been mentioned before, by reducing the acicular particles of $\alpha$-iron(III) oxide hydroxide containing metal(s) other than iron or the acicular particles of $\alpha$-ferric oxide containing metal(s) other than iron obtained by dehydration with heating of the former, in a reducing gas at a temperature in the range of 350° to 600° C. In this case, the reduction temperature becomes higher, the better the magnetic properties of the thus obtained acicular ferromagnetic alloy particles. On the other hand, it has been known that the deformation of the acicularity of the particles and the sintering between the particles becomes remarkable with the raise of the reduction temperature to cause the deterioration of the magnetic- and particle properties of the thus obtained acicular ferromagnetic alloy particles. Accordingly, in order to obtain the acicular ferromagnetic alloy particles while maintaining the original shape of acicular particle of $\alpha$-iron(III) oxide hydroxide containing metal(s) other than iron, the above-mentioned deformation and the mutual sintering between the particles should be prevented.

A method for attaining the above-mentioned preventive effect is to prepare the particle of $\alpha$-ferric oxide of high crystallinity and substantially high density while maintaining the original shape of acicular particle of $\alpha$-iron(III) oxide hydroxide. According to the method, the acicular particles of $\alpha$-iron(III) oxide hydroxide are heat-treated at a temperature in the range of 500° to 900° C. under a non-reducing atmosphere. Also in this case, the $\alpha$-ferric oxide particles of higher crystallinity are obtainable at a higher temperature of heating, however, when heated at a temperature of higher than 650° C., there is a demerit of excessive deformation of acicular particles due to the excessive sintering between the particles.

Another method for attaining the preventive effect is to coat the surface of the acicular particles of α-iron(III) oxide hydroxide with a compound having a sintering-preventing activity in advance of heat-treating at 500° to 900° C. to prepare the above-mentioned particles. For instance, by suspending the acicular particles of α-iron(III) oxide hydroxide into water after separating the particles formed by the ordinary method from the mother liquor of reaction while adjusting the pH of the suspension at a value higher than 6, adding to the aqueous suspension a phosphate in an amount of 0.1 to 2.0 wt% calculated as the amount of $PO_3$ and based on the amount of iron(III) oxide hydroxide, further adding a water-soluble silicate in an amount of 0.1 to 3 wt% calculated as the amount of $SiO_2$ and based in the amount of iron(III) oxide hydroxide and subsequently adjusting the pH value of the suspension to 3 to 5, it is possible to obtain the particles of α-iron(III) oxide hydroxide coated with phosphorous compound and silicon compound (refer to Japanese Patent Publication No. 22958/79).

However, the above-cited method is a method for obtaining the particles of α-iron(III) oxide hydroxide coated with phosphorus compound and silicon compound in order to prepare the acicular magnetic iron oxide particles, and accordingly, it can be hardly said that the same method is applicable in the case where the acicular magnetic alloy particles is to be prepared.

Accordingly, the object of the present invention is to provide a process for preparing the acicular ferromagnetic alloy particle of a high axial ratio and of substantially high density.

Another object of the present invention is to provide a process for producing the acicular ferromagnetic alloy particles suitable for use as the magnetic recording medium without causing the ultramicronization, the deformation of the acicularity of the particles and the sintering between the particles.

These and other objects of the present invention will become more apparent from the following description.

The foregoing and other objects of the present invention will be accomplished by the process of the present invention wherein after preparing an aqueous suspension of ferrous hydroxide and a water-soluble magnesium salt with pH of at least 11, an oxygen-containing gas is introduced into the suspension to form the acicular particles of α-iron(III) oxide hydroxide substituted with magnesium of a high axial ratio as the starting material and the thus-formed particles are heat-treated while maintaining the acicularity of the starting material.

BRIEF EXPLANATION OF DRAWINGS

FIGS. 3 and 4 show the acicular particles of α-iron(III) oxide hydroxide substituted with magnesium obtained in Example 2 and α-iron(III) oxide hydroxide obtained in Comparative Example 1, respectively. FIGS. 5 and 6 show the acicular ferromagnetic alloy particles mainly containing Fe and Mg obtained in Example 30 and the acicular ferromagnetic metal particles mainly containing Fe obtained in Comparative Example 5, respectively.

DETAILED DESCRIPTION OF THE INVENTION

According to the present invention, wherein in advance of oxidizing ferrous hydroxide by an oxygen-containing gas introduced the aqueous suspension containing the ferrous hydroxide, a water-soluble magnesium salt is added to the aqueous suspension containing ferrous hydroxide, the magnesium ion induces the formation of the nuclei of the acicular particle of α-iron(III) oxide hydroxide substituted with magnesium excellent in their axial ratio in the stage of the generation of the nuclei thereof and further suppresses the growth of the particles into the direction of the short axis while accelerating the growth of the particles into the direction of the long axis in the stage of the growth of the particles. It is the reason why the acicular particles of α-iron(III) oxide hydroxide substituted with magnesium excellent in the axial ratio are obtainable. Although the action of the water-soluble magnesium salt in these phenomena has not yet been elucidated, the inventors of the present invention consider that the fact of easier adsorption of magnesium ions on the surface parallel to the long axis of the particle than their adsorption on the surface perpendicular to the long axis of the particle in one of the dominant factors of the action and effect of magnesium ions in suppressing the growth of the particle to the direction of the short axis of the particle and on the other hand in accelerating the growth to the direction of the long axis of the particle in the growing stage of the particles. Further, it has been found as the result of the structure analysis of α-iron(III) oxide hydroxide prepared according to the present invention that magnesium substitutes in the acicular particles of α-iron(III) oxide hydroxide.

Based upon the experimental results obtained by the inventors of the present invention, the conditions and effects of the addition of the water-soluble magnesium salt will be described as follows while referring to the attached drawings.

Figure 1:
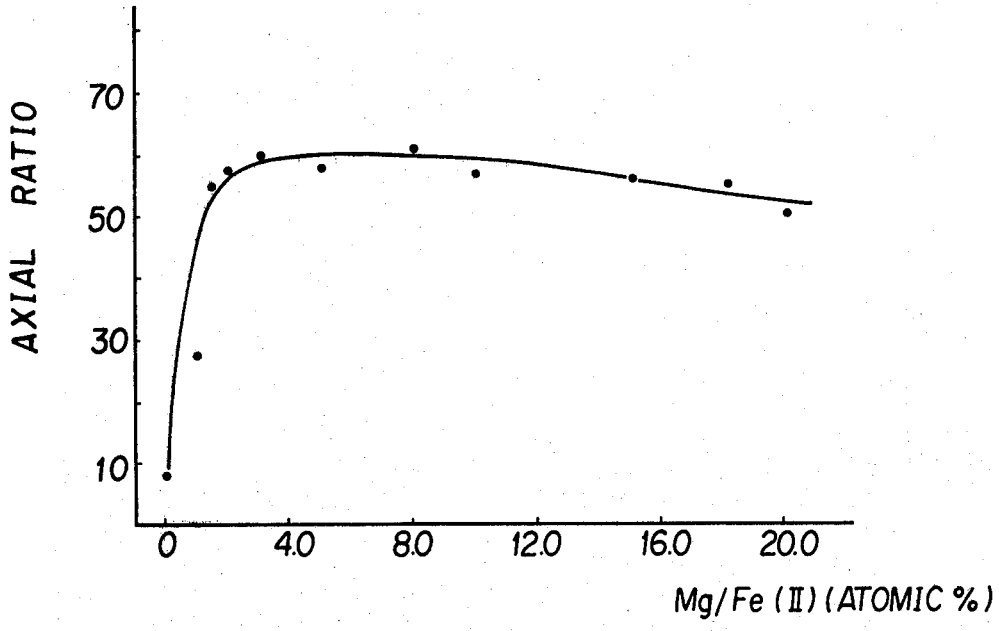
FIG. 1 shows a relation between the axial ratio of the acicular particles of α-iron(III) oxide hydroxide substituted with magnesium and amount of water-soluble magnesium salt added to the aqueous solution of ferrous sulfate.

FIG. 1 shows the relation between the axial ratio of the acicular particles of α-iron(III) oxide hydroxide substituted with magnesium and the amount of the water-soluble magnesium salt added to the aqueous solution of ferrous salt. Namely, after obtaining an aqueous suspension containing ferrous hydroxide at pH of about 13 by using an aqueous solution of ferrous sulfate at a concentration of 1.0 mol/liter obtained by adding magnesium sulfate in an amount of 0.1 to 20.0 atomic % calculated as the ratio of Mg to Fe(II) and based on the amount of the ferrous oxide (hereinafter referrded to as simply "calculated as the ratio of Mg/Fe(II)") and an aqueous solution of sodium hydroxide, the air is blown into the aqueous suspension at 45° C. at a rate of 1000 liters per minute to effect the oxidation of $Fe^{2+}$ to $Fe^{3+}$ in forming the acicular particles of α-iron(III)

oxide hydroxide substituted with magnesium, the above-mentioned axial ratio being determined on the thus formed particles and the amount of the water-soluble magnesium salt being the amount of added magnesium sulfate. As is shown in FIG. 1, there is a tendency of the raise of the axial ratio with the increase of the amount of the added water-soluble magnesium salt, magnesium sulfate.

Figure 2:
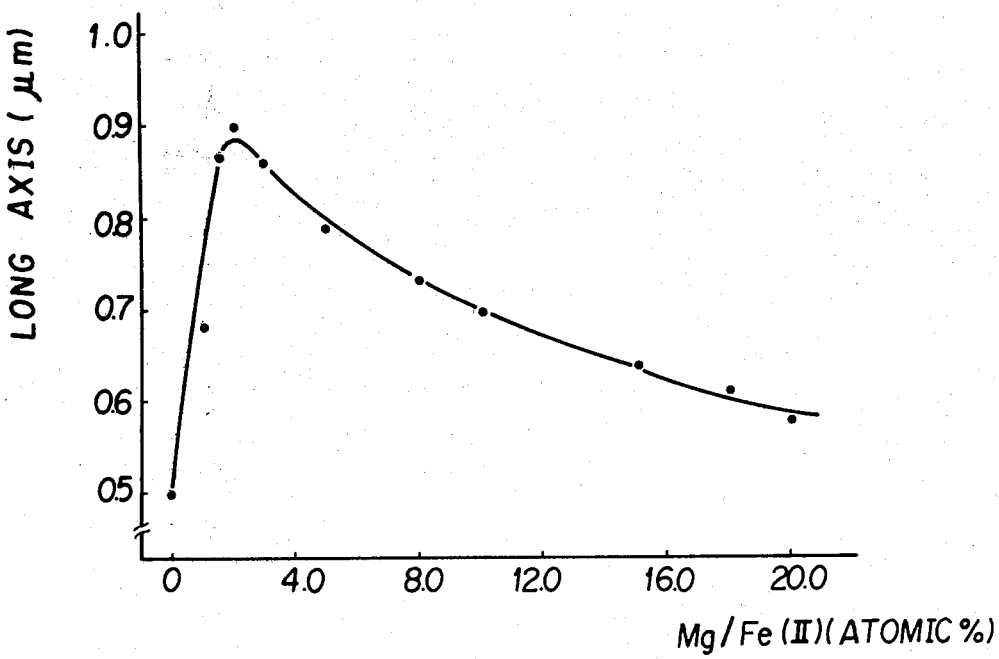
FIG. 2 shows a relation between the length of long axis of acicular particles of α-iron(III) oxide hydroxide substituted with magnesium and the amount of water-soluble magnesium salt added to the aqueous solution of ferrous sulfate under the same reaction conditions as in the case of FIG. 1.

FIG. 2 shows the relation between the length of long axis of the acicular particle of α-iron(III) oxide hydroxide substituted with magnesium formed under the same reaction conditions as these in the case of FIG. 1 and the amount of added water-soluble magnesium salt. As is shown in FIG. 2, the length of long axis of the particle shows a tendency of raising with the increase of the amount of added water-soluble magnesium salt until the amount of added magnesium sulfate reaches to 2 atomic % calculated as Mg/Fe(II), however, over 2 atomic %, the length shows a gradual reduction. The latter fact is considered to be caused by the suppression of the growth to the direction of the long axis of the particles due to the adsorption of magnesium ions also onto the surface perpendicular to the long axis of the particle in the presence of excessive amount of magnesium ions of magnesium salt.

However, with the simultaneously increased adsorption of magnesium ions on the surface parallel to the long axis of the particle, the growth of the particle into the direction of the short axis is further supressed, and accordingly, the axial ratio of the particle itself is not reduced even if the amount of addition of the water-soluble magnesium salt becomes more than 2 atomic % calculated as Mg/Fe(II) as seen in FIG. 1.

Figure 3:
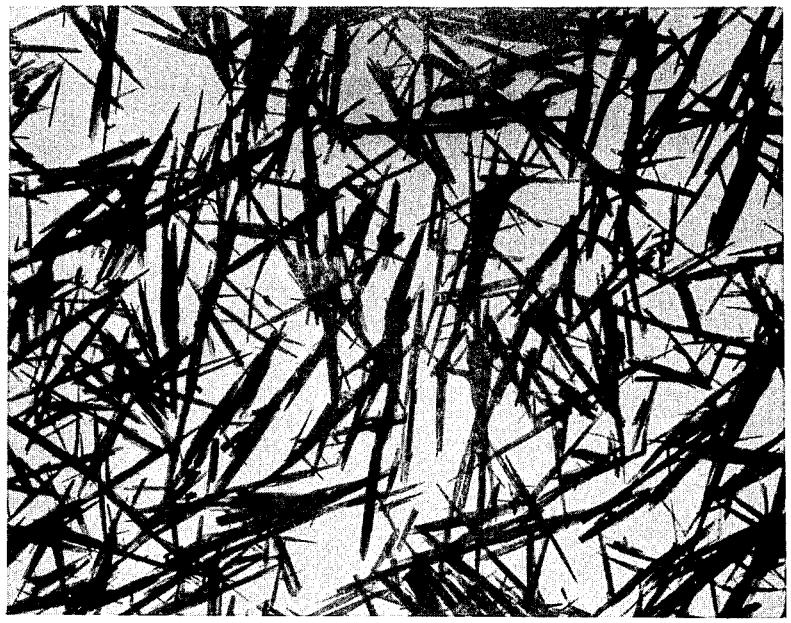
FIGS. 3 to 6 are electron microscope photographs taken at a magnification of 20,000 times.

FIG. 3 shows an electron microscope photograph figure (×20,000) of the acicular particles of α-iron(III) oxide hydroxide substituted with magnesium obtained by the process of the present invention (in Example 2, explained later on).

As is seen in FIG. 3, the particles have higher axial ratio.

The method for coating the thus-formed acicular particles with phosphorus compound and silicon compound according to the present invention is as follows. Namely, the acicular particles of α-iron(III) oxide hydroxide substituted with magnesium are coated by the method in which after separating the particles from the mother liquor and suspending the thus separated particles into the water while adjusting the pH of the suspension at a value higher than 8, a phosphate in an amount of 0.1 to 2 wt% calculated as the amount of $PO_3$ and based on the amount of α-iron(III) oxide hydroxide substituted with magnesium was added to the aqueous suspension, and after further adding a water-soluble silicate in an amount of 0.1 to 7.0 wt% calculated as the amount of $SiO_2$ and based on the amount of α-iron(III) oxide hydroxide substituted with magnesium to the aqueous suspension, the pH of the aqueous suspension is adjusted to 3 to 7.

After forming coats of phosphorus compound and subsequent silicon compound in a manner mentioned above, the resultant particles are heated at 500° to 900° C. under a non-reducing atmosphere and then reheated at 350° to 600° C. under reducing temperature to obtain the acicular ferromagnetic alloy particles mainly containing iron and magnesium. From the result of structure analysis of the thus-obtained particles, it is considered that iron and magnesium are in a state of solid solution.

Now the conditions for carrying out the process of the present invention will be explained in detail as follows.

In the first step of the process of the present invention, namely, the formation of the acicular particles of α-iron(III) oxide hydroxide substituted with magnesium, the aqueous solution of a ferrous salt to be used includes an aqueous solution of ferrous sulfate, an aqueous solution of ferrous chloride and the likes.

The water-soluble magnesium salt to be used in the process of the present invention includes magnesium sulfate, magnesium chloride, magnesium nitrate and the likes.

The addition of the water-soluble magnesium salt in the process of the present invention should be carried out in advance of the blowing of an oxygen-containing gas into the aqueous suspension containing ferrous hydroxide, and the addition may be carried out into the aqueous solution of the ferrous salt, the aqueous alkali solution or the aqueous suspension containing ferrous hydroxide.

In addition, even if the water-soluble magnesium salt is added in the stage where the blowing of oxygen-containing gas has begun and the nuclei of acicular α-iron(III) oxide hydroxide has been formed, any satisfactory effects can not be obtained.

The amount of water-soluble magnesium salt to be added according to the present invention is 0.5 to 20.0 atomic % based on the amount of ferrous hydroxide in the suspension and calculated as the ratio of Mg to Fe(II). In the case where the added amount is less than 0.5 atomic % calculated as Mg/Fe(II), the object of the present invention is not achieved. While, in the case where the added amount is more than 20.0 atomic % calculated as Mg/Fe(II), although the object of the present invention can be achieved, it is not so favorable because of the greatly reduced saturation magnetization of the thus obtained acicular magnetic particles of alloy mainly containing Fe and Mg due to the reduction of their purity. In consideration of the saturation magnetization of the particles, the preferable amount of addition of water-soluble magnesium salt is 0.5 to 15.0 atomic % calculated as Mg/Fe(II).

The length of long axis and the axial ratio of the thus obtained acicular particles of α-iron(III) oxide hydroxide substituted with magnesium are 0.3 to 2.0 μm on the average and more than 20:1, respectively. The particles of less than 0.3 or more than 2.0 μm in length on the average are not favorable as the starting material for preparing the magnetic material.

In the case where the axial ratio of acicular particles of α-iron(III) oxide hydroxide substituted with magnesium is less than 20:1, the acicular ferromagnetic particles of alloy mainly containing Fe and Mg, which have been obtained by thermal reduction of the acicular particles of α-iron(III) oxide hydroxide substituted with magnesium and coated with phosphorus compound and silicon compound have a history of a shrinkage of their volume in the step of thermal reduction and the axial ratio is hardly excellent, and accordingly, it is preferable that the axial ratio of the acicular particles of α-iron(III) oxide hydroxide substituted with magnesium is more than 20:1.

In the second step of the process according to the present invention, namely the formation of the acicular particles of α-iron(III) oxide hydroxide substituted with magnesium and coated with phosphorus compound and silicon compound, it is indispensable that a phosphate is added to the system before the membrane of $SiO_2$ for coating the particles is formed, in order to release the flocculation of the acicular particles of α-iron(III) oxide hydroxide substituted with magnesium.

The above-mentioned flocculation of the acicular particles can be released by the addition the phosphate in an amount of 0.1 to 2 wt% calculated as the amount of $PO_3$ and based on the amount of α-iron(III) oxide hydroxide substituted with magnesium after separating the particles of α-iron(III) oxide hydroxide substituted with magnesium from the mother liquor by filtration, washing with water and separating them into water while adjusting the pH of the suspension at a value higher than 8.

The concentration of the acicular particles of α-iron-(III) oxide hydroxide substituted with magnesium in an aqueous solution is preferably less than 20 wt%. In the case of over 20 wt%, the viscosity of the aqueous suspension is so large that the effect of releasing the flocculation of the acicular particles by the addition of the phosphate is not exhibited satisfactorily.

The amount of addition of the phosphate of 0.1 to 2 wt% calculated as the amount of $PO_3$ and based on the amount of α-iron(III) oxide hydroxide substituted with magnesium in the aqueous suspension is sufficient for releasing the flocculation of the particles and dispersing the particles uniformly in the aqueous suspension. In the case of less than 0.1 wt%, the effect of addition is not sufficiently exhibited, and on the other hand, in the case of more than 2 wt%, the dispersion of the particles is so strong and uniform that the separation of the particles by filtration is very much difficult and so not suitable for the purpose.

The phosphate to be added includes sodium metaphosphate, sodium pyrophosphate and the likes.

The pH value of the aqueous suspension to which the phosphate is added should not be lower than 8. Because in the case of not higher than 8, more than 2 wt% of the phosphate should be added and in such a case, there is a demerit of difficulty in filtration for separating the particles.

In the way mentioned above, the acicular particles of α-iron(III) oxide hydroxide substituted with magnesium are coated with phosphorus compound and then on the resultant particles, $SiO_2$ membranes are coated.

In the next step of forming a membrane of $SiO_2$ for coating the particles, the pH value of the aqueous suspension to which a water-soluble silicate is added for forming the coating membrane is preferably not lower than 8. In the case of adding the water-soluble silicate at the pH of not higher than 8, $SiO_2$ added separates out as solid and simultaneously with the addition and is not formed effectively as a homogenous membrane on the surface of the particles.

Accordingly, the water-soluble silicate is added to the aqueous suspension at a pH value of not lower than 8 and after dispersing the salt uniformly in the aqueous suspension, the pH value is adjusted to that at which $SiO_2$ deposites as solid, that is 3 to 7, and then $SiO_2$ deposites on the surface of the particles as a membrane. The amount of addition of the water-soluble silicate is 0.1 to 7.0 wt% calculated as the amount of $SiO_2$ and based on the amount of α-iron(III) oxide hydroxide substituted with magnesium. In the case of not more than 0.1 wt%, the effect of addition does not appear conspicuously, and on the other hand, in the case of not less than 7.0 wt%, although it is able to obtain the accicular ferromagnetic alloy particles mainly containing Fe and Mg, their saturation magnetization is reduced due to the lowering of purity of the product and accordingly, not favorable.

The water-soluble silicate for use in the step of coating includes sodium silicate, potassium silicate and the like.

After coating the particles with a membrane formed by the added phosphorus compound and silicon compound, in order to separate the thus coated particles from the aqueous suspension effectively by filtering, it is necessary that the particles which have been once dispersed in the aqueous phase by the addition of the phosphate are coagulated to a suitable degree. Namely, in the case where the amount of addition of the phosphate is in the range of 0.1 to 2 wt%, the viscosity of the aqueous suspension is raised by adjusting the pH of the aqueous dispersion to not higher than 7, and the particles become coagulate to cause the easier filtration. In this case, almost all the amount of the phosphate which has been added to disperse the particles is adsorbed onto the acicular particles of α-iron(III) oxide hydroxide substituted with magnesium without leaving any fear of causing the environmental problem due to the waste water.

In addition, also in the case where the pH of the aqueous suspension is adjusted to not higher than 3, the coagulation of the acicular particles of α-iron(III) oxide hydroxide substituted with magnesium, the adsorption of the phosphate and the formation of the $SiO_2$ coats are possibly carried out, however, such a situation is not preferable because of the problems of installation and quality of the product.

The adjustment of pH may be carried out with acetic acid, sulfuric acid, phosphoric acid, and the likes.

In the next step in which the resultant particles are heat-treated at 500° to 900° C. under a non-reducing atmosphere, the particles of α-iron(III) oxide hydroxide substituted with magnesium and coated with phosphorus compound and silicon compound which are substantially high in density are available without causing the deformation of the acicularity of the particles and the sintering between the particles while maintaining the original shape of the acicular particles.

In the case of the heat-treating temperature of not higher than 500° C., the crystallinity and density of the obtained acicular particles of α-ferric oxide are not substantially raised, and on the other hand, in the case of the temperature is not lower than 900° C., the deformation of the acicularity of the particles and the sintering between the particles are caused even after coating the particles with the membrane, and accordingly, both the temperature of heat-treatment of not higher than 500° C. and the temperature of not lower than 900° C. are not favorable.

Now the advantage of the present invention will be summarized as follows.

According to the present invention, the acicular ferromagnetic alloy particles of a high axial ratio and of substantially high density are easily produced without any special apparatus and technique, and the thus produced particles are of high coercive force and large saturation magnetization, and are of high dispersibility, high orientation and high packing property. Accordingly, the thus produced particles are favorably suitable as the magnetic material for recording of high output, high sensitivity and high density, which are at present most keenly required.

In addition, the acicular ferromagnetic alloy particles mainly containing Fe and Mg obtained according to the present invention have the same or better properties as compared to the conventional acicular ferromagnetic alloy particles mainly containing Fe and Co, Fe and Ni or Fe, Co and Ni obtained by similarly treating the acicular particles of α-iron(III) oxide hydroxide containing CO and/or Ni as in the present invention. Besides, since magnesium is more inexpensive as a raw material than cobalt and nickel, the ferromagnetic particles of the present invention is far more economic than those conventional particles.

It should be added that in the case of producing a magnetic paint while using the above-mentioned acicular ferromagnetic alloy particles mainly containing Fe and Mg of the present invention, a very favorable medium for magnetic recording having the particles excellently well oriented and packed in its coated film is available.

Now the present invention will be described by the examples and comparative examples.

The length of long axis and the axial ratio (long axis:-short axis) of the particle in the example and comparative examples were measured by the electron microscope photograph and indicated as the mean value, respectively.

PREPARATION OF STARTING MATERIAL PARTICLES

EXAMPLE 1

Into 400 liters of an aqueous 4.75 N sodium hydroxide solution, 400 liters of an aqueous solution of ferrous sulfate, at a concentration of 1.00 mol/liter in which 994 g of magnesium sulfate heptahydrate had been added to contain 1.0 atomic % calculated as Mg/Fe(II), was added at a temperature of 45° C. and pH of 13.4 to carry out a formation of an aqueous suspension of $Fe(OH)_2$ containing magnesium ion. Into the thus prepared aqueous suspension, air was blown at a rate of 1000 liters/minute for 16.6 hours at 45° C. to form an acicular particles of α-iron(III) oxide hydroxide substituted with magnesium. The termination of the oxidation reaction was determined by the blue colour reaction test of Fe(II) with red prussiate solution after extracting a portion of the reaction solution and acidifying it with hydrochloric acid.

The reaction mixture was then filtered to recover the thus formed acicular particles of α-iron(III) oxide hydroxide substituted with magnesium, and the particles were washed with water, a part of which was dried and purverized to be specimens for analysis and electron microscope photographic observation.

According to the X-ray diffraction, the thus obtained particles of α-iron(III) oxide hydroxide substituted with magnesium gave the same diffraction pattern as that of the authentic particles of α-iron(III) oxide hydroxide, and the results of X-ray fluorescence analysis of the specimen indicated the presence of magnesium. From these results, it is considered that magnesium substitutes in the acicular particles of α-iron(III) oxide hydroxide.

According to the electron microscope photographic observation, the acicular particles of α-iron(III) oxide hydroxide substituted with magnesium is 0.68 μm in length, and of an axial ratio of 28:1 on the average, and so excellent in the acicularity.

EXAMPLES 2 to 9

In the same manner as in Example 1 except for variously changing the kind of aqueous solution of ferrous salt, the concentration of aqueous sodium hydroxide solution and the kind and the amount of water-soluble magnesium salt and the time of addition thereof as shown in Table 1, the acicular particles of α-iron(III) oxide hydroxide substituted with magnesium were prepared, the main conditions for the preparation and properties of the particles being also shown in Table 1.

Every particles obtained in the respective Examples 2 to 9 was excellent in the acicularity according to the electron microscope photographic observation. FIG. 3 shows the electron microscope photograph of 20,000 times in magnification of the acicular particles of α-iron(III) oxide hydroxide substituted with magnesium obtained in Example 2.

COMPARATIVE EXAMPLE 1

Figure 4:
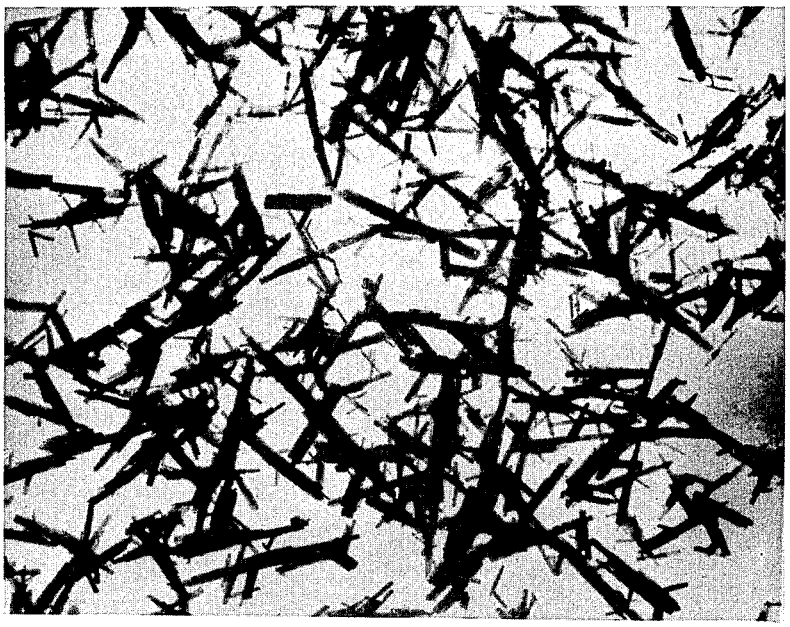

In the same manner as in Example 1, however, without adding magnesium sulfate, the acicular particles of α-iron(III) oxide hydroxide were prepared under the conditions also shown in Table 1, together with the specific properties of the product. FIG. 4 shows the electron microscope photograph of 20,000 times in magnification of the product, the acicular particles of α-iron(III) oxide hydroxide.

As is seen in FIG. 4, the thus obtained particles was 0.48 μm in length and the axial ratio of 9:1, and so poor in the acicularity.

COATING OF PARTICLES WITH PHOSPHORUS COMPOUND AND SILICON COMPOUND

EXAMPLE 10

Into 40 liters of water, 3700 g of a paste of the particles prepared in Example 1, filtered and washed with water (corresponding to about 1000 g of the acicular particles of α-iron(III) oxide hydroxide substituted with magnesium was suspended, the pH of the aqueous suspension being 9.8. Subsequently, 200 ml of an aqueous solution of 6 g of sodium hexametaphosphate (corresponding to 0.42 wt% calculated as the amount of α-iron(III) oxide hydroxide substituted with magnesium) was added to the aqueous suspension, and after stirring for 30 minutes, 100 g of sodium silicate (Water glass No. 3, corresponding to 2.8 wt% calculated as the amount of $SiO_2$ to α-iron(III) oxide hydroxide substituted with magnesium) was further added to the aqueous suspension. After stirring the mixture for 60 minutes, an aqueous 10% solution of acetic acid was added to make the pH of the mixture 6.0, and the mixture was filtered by a press filter to collect the solid which was dried and pulverized to the the acicular particles of α-iron(III) oxide hydroxide substituted with magnesium and coated with a phosphorus compound and a silicon compound.

EXAMPLES 11 to 18 and COMPARATIVE EXAMPLE 2

In the same manner as in Example 10 except for changing the kind of the particles to be treated, pH of the suspension at the time of adding phosphate, the amount of added phosphate, the amount of added water-soluble silicate, and pH of the mixture after adding acetic acid, the particles coated with the phosphorus compound and the silicon compound were prepared.

The main conditions for this preparation are shown in Table 2 with those of Example 10.

PREPARATION OF ACICULAR α-FERRIC OXIDE PARTICLES

EXAMPLE 19

Six hundred grams of the acicular particles of α-iron-(III) oxide hydroxide substituted with magnesium and coated with the phosphorus compound and the silicon compound was heat-treated in the air at 770° C. to obtain the acicular particles of ferric oxide substituted with magnesium and coated with the phosphorus compound and the silicon compound.

According to electron microscope photographic observation, the length of long axis of the particle was 0.66 μm and the axial ratio of the particle was 27:1, both the data illustrating the excellent of the particle in the acicularity.

EXAMPLES 20 to 28 and COMPARATIVE EXAMPLE 4

In the same manner as in Example 19, except for changing the kind of the particles to be treated, the heat-treating temperature and the non-reducing atomosphere, the acicular particles of α-ferric oxide substituted with magnesium were prepared, the main conditions for preparing the particles and their specific properties being shown in Table 3 together with those of the product in Example 19. In addition, the length of long axis and the axial ratio of the particles obtained in Comparative Example 4 were respectively 0.56 μm and 28:1 showing the deformation of the acicularity of the particles and the sintering between the particles.

COMPARATIVE EXAMPLE 3

The acicular particles of iron(III) oxide hydroxide were heat-treated at 750° C. in a non-reducing atmosphere to prepare the acicular α-ferric oxide particles, the specific properties of the product being shown also in Table 3.

PREPARATION OF ACICULAR FERROMAGNETIC ALLOY PARTICLES OR ACICULAR FERROMAGNETIC IRON PARTICLES

EXAMPLE 29

In a 3-liter retort with one opened end, 150 g of the acicular particles of α-ferric oxide substituted with magnesium and coated with the phosphorus compound and the silicon compound obtained in Example 19 was placed, and hydrogen gas was passed through the retort at a rate of 50 liters/minute and at 490° C. while rotating the retort to carry out the reduction of the particles therein. After the reduction was over, the product was once soaked in toluene and toluene was evaporated to form a stable oxidized membrane on the surface of the particles in order to prevent the sudden oxidation when the product was put out from the retort into the ambient air. The thus produced acicular ferromagnetic alloy particles mainly containing Fe and Mg showed the same X-ray diffraction pattern of a single phase of body-centered cubic lattice as that of Fe, and as a result of fluorescent X-ray analysis, magnesium was detected in the product. Accordingly, it is considered that iron and magnesium are in a state of solid solution. The specific properties of the product are shown in Table 4.

EXAMPLES 30 to 38 and COMPARATIVE EXAMPLE 6

Figure 5:
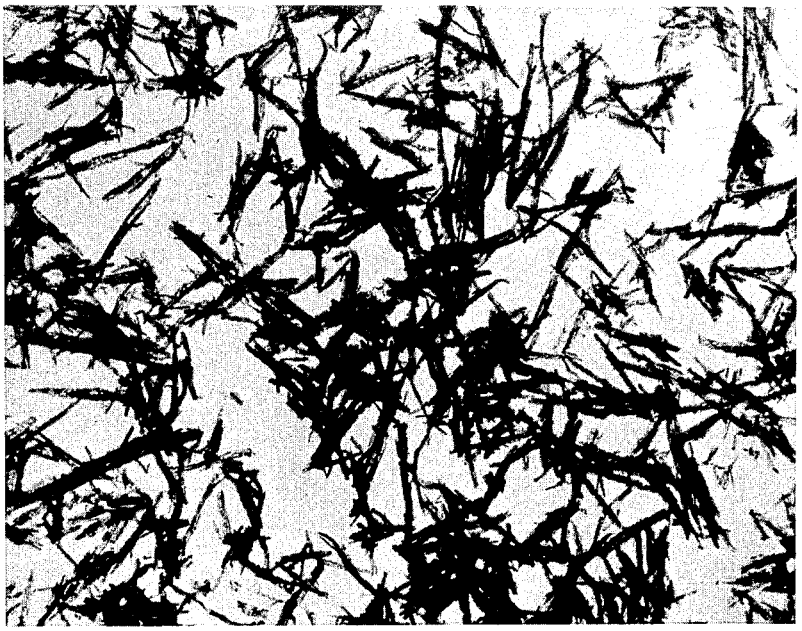

In the same manner as in Example 29 except for changing the kind of the acicular particles of α-ferric oxide substituted with magnesium and coated with the phosphorus compound and the silicon compound and the temperature of reduction, the acicular ferromagnetic alloy particles mainly containing Fe and Mg were obtained, the specific properties of the product being shown also in Table 4. The products of Examples 30 to 38 were excellent in the acicularity according to electron microscope photographic observation. FIG. 5 shows the electron microscope photograph of 20,000 times in magnification of the product of Example 30. The length of long axis and the axial ratio of the product obtained in Comparative Example 6 were 0.35 μm and 7:1, respectively showing the deformation of acicularity of the particle and the sintering between the particles.

COMPARATIVE EXAMPLE 5

Figure 6:
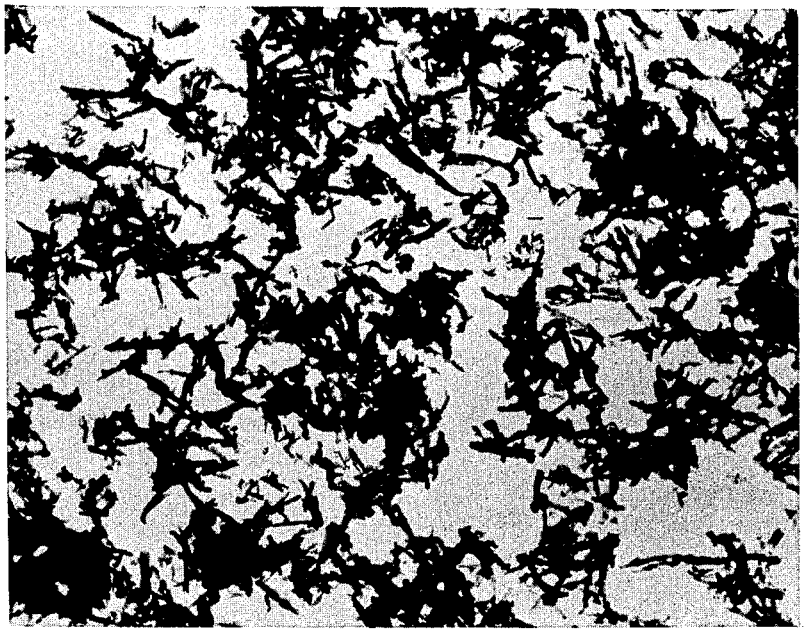

In the same manner as in Example 29, the acicular ferromagnetic metal particles mainly containing iron were prepared while using the acicular α-ferric oxide particles coated with the phoshorus compound and silicon compound obtained in Comparative Example 3. As is seen in FIG. 6, the electron microscope photograph of 20,000 times in magnification of the product, the length of long axis of the particle was 0.3 μm and the axial ratio of the particle was 5:1, indicating the poorness in the acicularity.

PRODUCTION OF MAGNETIC TAPE

EXAMPLE 39

A magnetic paint was prepared by compounding the acicular magnetic alloy particles mainly containing Fe and Mg obtained in Example 29, a suitable amount of a dispersing agent, a copolymer of vinyl chloride and vinyl acetate, thermoplastic polyurethane and a mixed solvent comprising toluene, ethyl methyl ketone and isobutyl methyl ketone in a predetermined composition and by introducing the mixture to a ball mill and mixing to disperse therein for 8 hours. After adding the mixed solvent to the thus prepared magnetic paint to be a suitable viscosity, the paint was applied onto a polyester film and dried according to the ordinary method to produce a magnetic tape. The coercive force, the residual magnetic flux density, squareness ratio of Br/Bm, and orientation ratio of the thus obtained magnetic tape were Hc of 1034 Oe, Br of 3520 Gauss, 0.814 and 2.74, respectively.

EXAMPLES 40 to 48 and COMPARATIVE EXAMPLE 7

In the same manner as in Example 39 except for changing the kind of the acicular ferromagnetic particles, magnetic tapes were produced. The specific properties of the thus obtained magnetic tapes are shown in Table 5.

TABLE 1

| Examples and Comparative Example | Production of acicular particles of α-FeO(OH) substituted with Mg: Aueous Fe(II) solution | | | Aqueous NaOH solution | | Water-soluble Mg salt | | | | Acicular α-FeO(OH) particles Properties of particles | |
|---|---|---|---|---|---|---|---|---|---|---|---|
| | Kind | Concentration (mol/l) | Added amount (l) | Concentration (N) | Added amount (l) | Kind | Added amount of Mg (atomic %) | Time* of the addition | Reaction time (hour) | Long axis (μm) | Axial ratio (long axis: short axis) |
| Example | | | | | | | | | | | |
| 1 | $FeSO_4$ | 1.00 | 400 | 4.75 | 400 | $MgSO_4 \cdot 7H_2O$ | 1.0 | A | 16.6 | 0.68 | 28:1 |
| 2 | " | " | " | 4.80 | " | $MgSO_4 \cdot 7H_2O$ | 2.0 | " | 18.4 | 0.90 | 58:1 |
| 3 | " | " | " | " | " | $MgSO_4 \cdot 7H_2O$ | 3.0 | " | 22.5 | 0.86 | 60:1 |
| 4 | " | " | " | 4.85 | " | $MgSO_4 \cdot 7H_2O$ | 5.0 | " | 18.1 | 0.79 | 58:1 |
| 5 | " | " | " | 4.90 | " | $MgSO_4 \cdot 7H_2O$ | 10.0 | " | 14.5 | 0.70 | 57:1 |
| 6 | " | " | " | 5.00 | " | $MgSO_4 \cdot 7H_2O$ | 15.0 | " | 13.5 | 0.64 | 56:1 |
| 7 | $FeCl_2$ | " | " | 4.80 | " | $MgCl_2 \cdot 6H_2O$ | 2.0 | " | 18.2 | 0.92 | 58:1 |
| 8 | $FeSO_4$ | " | " | " | " | $MgSO_4 \cdot 7H_2O$ | " | B | 18.1 | 0.88 | 60:1 |
| 9 | " | " | " | " | " | $MgSO_4 \cdot 7H_2O$ | " | C | 17.8 | 0.92 | 57:1 |
| Comparative Example | | | | | | | | | | | |
| 1 | $FeSO_4$ | " | " | 4.70 | " | — | — | — | 14.1 | 0.48 | 9:1 |

*A: Water-soluble Mg salt was added to an aqueous Fe(II) solution.
B: Water-soluble Mg salt was added to an alkaline aqueous solution.
C: Water-soluble Mg salt was added to an aqueous suspension of $Fe(OH)_2$.

TABLE 2

| Examples and Comparative Example | Production of acicular particles of a α-FeO(OH) substituted with Mg and coated with P compound and Si compound: Kind of particles to be treated (Example No. and Comparative Example No.) | pH of suspension | Added amount of $PO_3$ (wt %) | Added amount of $SiO_2$ (wt %) | pH after adjustment |
|---|---|---|---|---|---|
| Example | Example | | | | |
| 10 | 1 | 9.8 | 0.42 | 2.8 | 6.0 |
| 11 | 2 | 9.5 | 0.42 | 1.4 | 6.0 |
| 12 | 3 | 9.6 | 0.35 | 2.8 | 6.5 |
| 13 | 4 | 9.6 | 0.35 | 2.8 | 6.0 |
| 14 | 5 | 9.8 | 0.56 | 3.8 | 5.0 |
| 15 | 6 | 9.8 | 1.06 | 0.84 | 4.5 |
| 16 | 7 | 9.6 | 1.58 | 4.2 | 4.0 |
| 17 | 8 | 9.7 | 0.28 | 5.6 | 3.5 |
| 18 | 9 | 9.6 | 0.42 | 2.8 | 6.0 |
| Comparative Example | Comparative Example | | | | |
| 2 | 1 | 9.3 | 0.35 | 2.8 | 6.0 |

TABLE 3

| Examples and Comparative Examples | Kind of particles to be treated (Example No. and Comparative Example No.) | Production of acicular particles of α-$Fe_2O_3$ substituted with Mg and coated with P compound and Si compound: Heat-treating temperature (°C.) | Non-reducing atmosphere | Properties of particles: Long axis (μm) | Axial ratio (long axis:short axis) |
|---|---|---|---|---|---|
| Example | Example | | | | |
| 19 | 10 | 770 | Air | 0.66 | 27:1 |
| 20 | 11 | 700 | " | 0.87 | 56:1 |
| 21 | 12 | 750 | " | 0.84 | 58:1 |
| 22 | 13 | 750 | " | 0.76 | 57:1 |
| 23 | 14 | 750 | " | 0.68 | 55:1 |
| 24 | 15 | 550 | " | 0.63 | 54:1 |
| 25 | 16 | 800 | " | 0.88 | 56:1 |
| 26 | 17 | 850 | " | 0.85 | 57:1 |
| 27 | 18 | 750 | " | 0.89 | 57:1 |
| 28 | 18 | 850 | Nitrogen | 0.84 | 49:1 |
| Comparative | Comparative | | | | |

TABLE 3-continued

| Examples and Comparative Examples | Kind of particles to be treated (Example No. and Comparative Example No.) | Production of acicular particles of $\alpha$-$Fe_2O_3$ substituted with Mg and coated with P compound and Si compound | | | |
|---|---|---|---|---|---|
| | | Heat-treating temperature (°C.) | Non-reducing atmosphere | Properties of particles: Long axis (μm) | Properties of particles: Axial ratio (long axis:short axis) |
| Example | Example | | | | |
| 3 | 2 | 750 | Air | 0.44 | 9:1 |
| | Example | | | | |
| 4 | 18 | 950 | " | 0.56 | 28:1 |

TABLE 4

| Examples and Comparative Examples | Kind of particles to be treated (Example No. and Comparative Example No.) | Reduction temperature (°C.) | Production of acicular ferromagnetic alloy particles mainly containing Fe and Mg: Properties of particles: Long axis (μm) | Properties of particles: Axial ratio (long axis: short axis) | Magnetic properties: Saturation magnetization (σs) (emu/g) | Magnetic properties: Coercive force (Hc) (Oe) |
|---|---|---|---|---|---|---|
| Example | Example | | | | | |
| 29 | 19 | 490 | 0.50 | 12:1 | 162.3 | 1212 |
| 30 | 20 | 450 | 0.55 | 15:1 | 161.5 | 1426 |
| 31 | 21 | 490 | 0.60 | 21:1 | 156.0 | 1537 |
| 32 | 22 | 490 | 0.60 | 25:1 | 152.0 | 1595 |
| 33 | 23 | 490 | 0.55 | 16:1 | 130.5 | 1456 |
| 34 | 24 | 380 | 0.55 | 13:1 | 118.6 | 1381 |
| 35 | 25 | 500 | 0.55 | 15:1 | 162.3 | 1430 |
| 36 | 26 | 540 | 0.55 | 13:1 | 163.5 | 1406 |
| 37 | 27 | 470 | 0.55 | 15:1 | 166.2 | 1448 |
| 38 | 28 | 500 | 0.50 | 12:1 | 161.0 | 1304 |
| Comparative Example | Comparative Example | | | | | |
| 5 | 3 | 490 | 0.30 | 5:1 | 172.1 | 1038 |
| | Example | | | | | |
| 6 | 27 | 630 | 0.35 | 7:1 | 164.2 | 1060 |

TABLE 5

| Examples and Comparative Example | Kind of magnetic particles (Example No. and Comparative Example No.) | Properties of Tape: Coercive force (Hc) (Oe) | Properties of Tape: Residual magnetic flux (Br) (Gauss) | Properties of Tape: Squareness ratio (Br/Bm) | Properties of Tape: Orientation ratio (Br/Bm)‖ / (Br/Bm)⊥ |
|---|---|---|---|---|---|
| Example | Example | | | | |
| 39 | 29 | 1034 | 3520 | 0.814 | 2.74 |
| 40 | 30 | 1285 | 3460 | 0.843 | 2.84 |
| 41 | 31 | 1396 | 3580 | 0.853 | 2.95 |
| 42 | 32 | 1450 | 3630 | 0.860 | 3.01 |
| 43 | 33 | 1300 | 3060 | 0.830 | 2.78 |
| 44 | 34 | 1225 | 3010 | 0.810 | 2.68 |
| 45 | 35 | 1260 | 3520 | 0.819 | 2.75 |
| 46 | 36 | 1213 | 3490 | 0.815 | 2.69 |
| 47 | 37 | 1296 | 3520 | 0.827 | 2.78 |
| 48 | 38 | 1102 | 3320 | 0.790 | 2.58 |
| Comparative Example | Comparative Example | | | | |
| 7 | 5 | 903 | 2970 | 0.730 | 1.79 |

What is claimed is:

1. A process for producing an acicular ferromagnetic alloy particles mainly containing iron and magnesium, which comprises preparing a suspension of iron(II) hydroxide and water-soluble magnesium salt, the suspension having a pH value of at least 11 and containing the magnesium salt in an amount of 0.5 to 20.0 atomic % based on the amount of the iron(II) hydroxide in the suspension and calculated as the ratio of Mg to Fe(II), oxidizing the suspension with an oxygen-containing gas to form an acicular particles of iron(III) oxide hydroxide substituted with magnesium, forming coats of phosphorus compound and subsequent silicon compound on the acicular particles, heating the resultant particle at 500° to 900° C. under a non-reducing atmosphere and then reheating the particle thus treated at 350° to 600° C. under reducing atmosphere.

2. The process of claim 1, wherein the acicular iron(III) oxide hydroxide is a particle of the length of long axis of 0.3 to 2.0 μm and the axial ratio of more than 20:1.

3. The process of claim 1, wherein the step of forming coats comprises the steps of:

preparing an aqueous suspension of acicular iron(III) oxide hydroxide while adjusting the pH of the suspension at a value higher than 8;

adding a phosphate in an amount of 0.1 to 2 wt% calculated as the amount of $PO_3$ and based on the amount of the iron(III) oxide hydroxide into the suspension;

adding a water-soluble silicate in an amount of 0.1 to 7.0 wt% calculated as the amount of $SiO_2$ and based on the amount of the iron(III) oxide hydroxide into the suspension; and then adjusting the pH of the suspension in the range of 3 to 7.

4. The process of claim 1, wherein the amount of water-soluble magnesium salt is preferably in the range of 0.5 to 15.0 atomic % based on the amount of iron(II) hydroxide in the suspension and calculated as the ratio of Mg to Fe(II).

5. An acicular ferromagnetic alloy particles mainly containing iron and magnesium obtained by preparing a suspension of iron(II) hydroxide and water-soluble magnesium salt, the suspension having a pH value of at least 11 and containing the magnesium salt in an amount of 0.5 to 20.0 atomic % based on the amount of the iron(II) hydroxide in the suspension and calculated as the ratio of Mg to Fe(II), oxidizing the suspension with an oxygen-containing gas to form an acicular particles of iron(III) oxide hydroxide substituted with magnesium, forming coats of phosphorus compound and subsequent silicon compound on the acicular particles, heating the resultant particle at 500° to 900° C. under a non-reducing atmosphere and then reheating the particle thus treated at 350° to 600° C. under reducing atmosphere.

6. The acicular ferromagnetic alloy particles of claim 5, wherein the acicular iron(III) oxide hydroxide is a particle of the length of long axis of 0.3 to 2.0 μm and the axial ratio of more than 20:1.

7. The acicular ferromagnetic alloy particles of claim 5, wherein the step of forming coats comprises the steps of:

preparing an aqueous suspension of acicular iron(III) oxide hydroxide while adjusting the pH of the suspension at a value higher than 8;

adding a phosphate in an amount of 0.1 to 2 wt% calculated as the amount of $PO_3$ and based on the amount of the iron(III) oxide hydroxide into the suspension;

adding a water-soluble silicate in an amount of 0.1 to 7.0 wt% calculated as the amount of $SiO_2$ and based on the amount of the iron(III) oxide hydroxide into the suspension; and then adjusting the pH of the suspension in the range of 3 to 7.

8. The acicular ferromagnetic alloy particles of claim 5, wherein the amount of water-soluble magnesium salt is preferably in the range of 0.5 to 15.0 atomic % based on the amount of iron(II) hydroxide in the suspension and calculated as the ratio of Mg to Fe(II).

* * * * *